US007484934B2

(12) United States Patent
Guzorek

(10) Patent No.: US 7,484,934 B2
(45) Date of Patent: Feb. 3, 2009

(54) METHOD AND APPARATUS FOR PROPELLING AN INTERCEPTED FLUID

(75) Inventor: Steven E. Guzorek, Kinston, NC (US)

(73) Assignee: Field Controls, LLC, Kinston, NC (US)

( * ) Notice: Subject to any disclaimer, the term of this patent is extended or adjusted under 35 U.S.C. 154(b) by 388 days.

(21) Appl. No.: 11/411,486

(22) Filed: Apr. 26, 2006

(65) Prior Publication Data

US 2008/0219847 A1 Sep. 11, 2008

(51) Int. Cl.
*B63H 1/16* (2006.01)
*F01D 5/22* (2006.01)

(52) U.S. Cl. ..... 416/183; 416/196 R

(58) Field of Classification Search ..... 416/182, 416/183, 185, 196 R
See application file for complete search history.

(56) References Cited

U.S. PATENT DOCUMENTS

| | | | | |
|---|---|---|---|---|
| 1,121,335 | A | | 12/1914 | Dilg |
| 1,149,904 | A | | 8/1915 | Foster |
| 1,255,346 | A | | 2/1918 | Sparks |
| 2,581,872 | A | | 1/1952 | Morrison |
| 3,127,094 | A | | 3/1964 | Smith |
| 3,625,635 | A | | 12/1971 | Stonack |
| 3,659,959 | A | | 5/1972 | Holstrom |
| 3,733,147 | A | | 5/1973 | Felker |
| 4,037,987 | A | * | 7/1977 | Charles et al. ..... 416/132 A |
| 4,102,601 | A | * | 7/1978 | Bischoff ..... 416/183 |
| 4,139,330 | A | | 2/1979 | Neal |
| 4,147,471 | A | * | 4/1979 | Charles ..... 416/132 A |
| 4,249,861 | A | * | 2/1981 | Charles ..... 416/132 A |
| 4,338,062 | A | | 7/1982 | Neal |
| 4,826,405 | A | | 5/1989 | Robb |
| 5,083,904 | A | | 1/1992 | Masatsugu et al. |
| 5,863,182 | A | | 1/1999 | Hill et al. |
| 6,386,831 | B1 | | 5/2002 | Stahl et al. |

* cited by examiner

*Primary Examiner*—Igor Kershteyn
(74) *Attorney, Agent, or Firm*—Wood, Phillips, Katz, Clark & Mortimer

(57) ABSTRACT

An apparatus that is rotatable around a first axis to propel an intercepted fluid in a radial direction. The apparatus has a support, a first blade assembly, and a second blade assembly. The first blade assembly has a first blade with a first substantially flat surface residing in a first plane that is substantially parallel to the first axis. The second blade assembly has second and third blades respectively having second and third substantially flat surfaces residing respectively in second and third planes, each extending substantially parallel to the first axis. A single piece defines at least a part of the second and third substantially flat surfaces. The second blade assembly is separate from the first blade assembly and joined to the support so that the blades cooperatively propel intercepted fluid in a radial direction.

29 Claims, 8 Drawing Sheets

FIG. 4
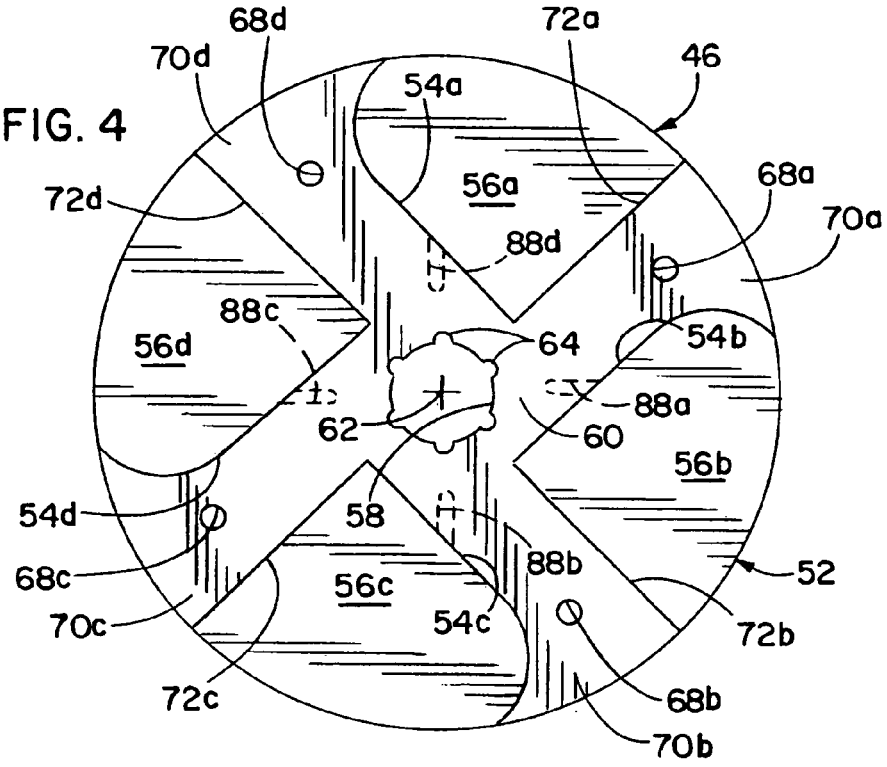
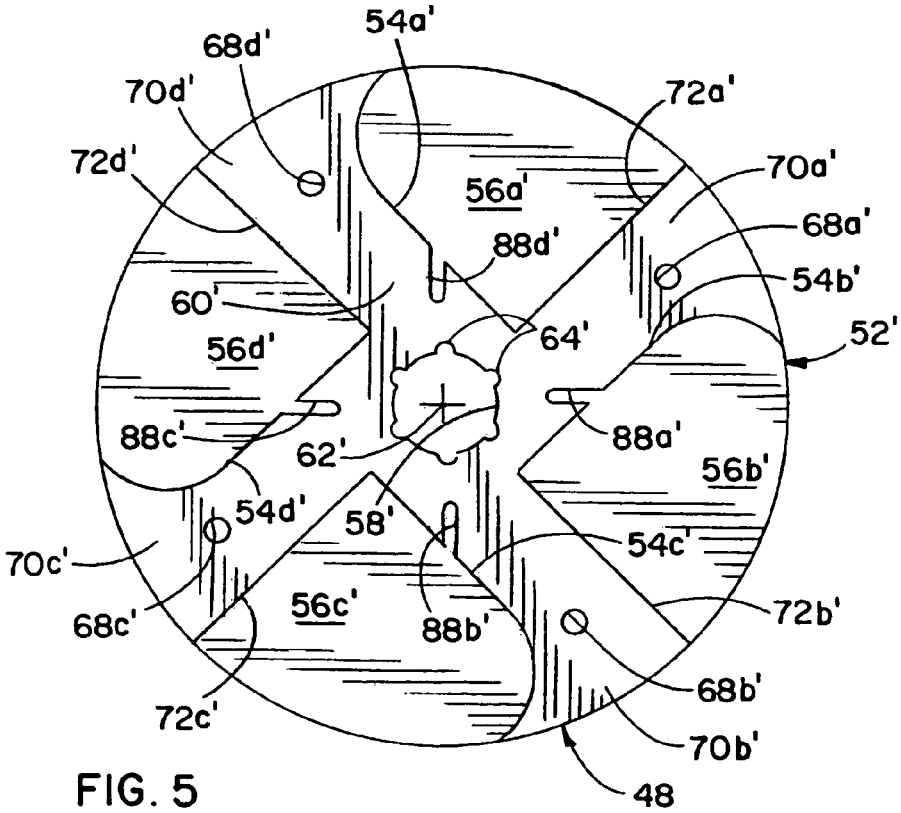
FIG. 5

METHOD AND APPARATUS FOR PROPELLING AN INTERCEPTED FLUID

BACKGROUND OF THE INVENTION

1. Field of the Invention

This invention relates to fluid propulsion and, more particularly, to a bladed, rotary apparatus through which an intercepted fluid is centrifugally propelled with respect to a rotary axis.

2. Background Art

Bladed, centrifugal-type rotary apparatus are used in many different environments to propel fluids that may be in liquid or gaseous form. As an example, this type of rotary apparatus is used on furnaces to both direct heated air into a space to be conditioned and exhaust combustion products to an external environment.

There are currently several different ways that such bladed, rotary apparatus are constructed. For example, it is known to mold such a rotary apparatus in one piece from metal or plastic. Particularly in the case of metal, this can be a relatively expensive process.

It is also known to form this type of rotary apparatus from a single metal sheet. The sheet can be struck through at the outlines of the blades which are then bent generally at right angles to the plane of the sheet. While the apparatus can be formed economically using this method, it has one particular drawback. The axial extent of the blades is inherently limited by the geometry of the sheet. As the number of blades increases, the permissible axial extent thereof is correspondingly decreased.

It is also known to form a rotary apparatus by providing a flat support and attaching individual blades that are separately formed from the base. An example of this type of construction is shown in U.S. Pat. No. 3,127,094.

A drawback with this latter design is that by reason of having to individually attach each blade, there is a possibility that optimal alignment may not be achieved between each blade and the other blades and rotary axis. Resultingly, this structure is prone to being dynamically imbalanced. Also, the manufacturing process for such an apparatus is inherently complicated by reason of having to install the multiple blade components with multiple separate fasteners. This translates into additional costs that may have to be passed on to the consumer.

The industry continues to seek out designs of rotary, bladed, centrifugal-type apparatus that can be made economically and with consistent operating characteristics to meet different design criteria.

SUMMARY OF THE INVENTION

In one form, the invention is directed to an apparatus that is rotatable around a first axis to propel an intercepted fluid in a radial direction. The apparatus has a support capable of being rotated around the first axis, a first blade assembly, and a second blade assembly. The first blade assembly has a first blade with a first substantially flat surface residing in a first plane that is substantially parallel to the first axis. The second blade assembly has second and third blades respectively having second and third substantially flat surfaces residing respectively in second and third planes, each extending substantially parallel to the first axis with the second blade assembly in an operative position on the support. A single piece defines at least a part of the second and third substantially flat surfaces. The second blade assembly is separate from the first blade assembly and joined to the support in the operative position so that the first, second and third blades cooperatively propel intercepted fluid in a radial direction relative to the first axis as the apparatus is rotated around the first axis.

The single piece may be a formable material that is bent to define the first and second blades.

In one form, with the second blade assembly in the operative position, the second and third blades are at diametrically opposite second and third locations relative to the first axis.

In one form, a first web connects between the second and third blades and the second blade assembly is joined to the support through the first web.

In one form, the first blade assembly has a fourth blade with a fourth substantially flat surface that is in a fourth plane that is substantially parallel to the first axis.

In one form, there is a single piece that defines at least a part of the first and fourth substantially flat surfaces.

In one form, the first blade assembly has a second web that connects between the first and fourth blades and through which the first blade assembly is joined to the support in an operative position.

At least one of the first and second blade assemblies may define at least part of the support.

In one form, the first and fourth blades are at diametrically opposite first and fourth locations relative to the first axis.

The first and second blade assemblies may be stacked axially with respect to the first axis, one upon the other.

In one form, there is a first web that connects between the second and third blades and the support includes a shaft that extends through the first and second webs.

In one form, the shaft has a free end and the apparatus further includes a securing element that is attached to the free end of the shaft.

The second and third planes may be substantially parallel to each other.

In one form, the first blade assembly has a fourth blade with a fourth substantially flat surface that is in a fourth plane that is substantially parallel to the first axis, and the first and fourth planes are substantially parallel to each other.

The first web and second and third blades may be made from a single piece of formable material that is bent from an initially flattened state to define the first web and second and third blades.

The first blade assembly may include a second web that connects between the first and fourth blades and through which the first blade assembly is joined to the support in an operative position. The first web may be connected by a fastener to at least one of the second web and support at a location spaced from the first axis.

In one form, there is a third blade assembly having at least one blade and a third web and the shaft extends through the third web to maintain the third blade assembly in an operative position on the support.

The formable material may be a metal.

The invention is further directed to an apparatus that is rotatable around a first axis to propel an intercepted fluid in a radial direction and having a support capable of being rotatable around a first axis and first and second blade assemblies. The support has a shaft. The first blade assembly is separate from the first blade assembly and has a first blade having a first flat surface residing in a first plane and a first web. The second blade assembly has a second blade having a second flat surface residing in a second plane and a second web. The shaft extends through the first and second webs to maintain the first and second blade assemblies each in an operative position wherein the first and second planes are substantially parallel to the first axis and the first and second blades cooperatively propel intercepted fluid in a radial direction relative to the first axis as the apparatus is rotated around the first axis.

The first blade assembly may be formed from a single piece of formable material that is bent to define the first web and first blade.

The first blade assembly may include a third blade formed at least in part from the single piece that also defines at least a part of the first blade and first web. The third blade has a third substantially flat surface that resides in a third plane that is substantially parallel to the first axis with the first blade assembly in its operative position.

In one form, the first web is connected by a fastener to at least one of the support and the second web at a location spaced from the first axis.

The first and third substantially flat surfaces may be substantially parallel to each other.

The single piece of formable material may be a flattened piece of metal that is bent to define the first web and first and third blades.

The invention is further directed to a method of forming an apparatus that is rotatable around a first axis to propel an intercepted fluid in a radial direction. The method includes the steps of: forming a first blade assembly having at least a first blade with a first substantially flat surface residing in a first plane and a first web; forming a second blade assembly having at least a second blade with a second substantially flat surface residing in a second plane and a second web; and joining the first and second webs together at a support that is rotatable around the first axis so that the first and second blades align to be substantially parallel to the first axis and the first and second blades cooperatively propel intercepted fluid in a radial direction as the apparatus is rotated around the first axis.

The step of forming the first blade assembly may involve forming the first blade assembly from a single piece of formable material that is bent to define the first web and first blade.

The support may include a shaft, with the step of joining the first and second webs together involving directing the shaft axially relative to the first axis through the first and second webs. The method may further include the step of attaching a securing element to the shaft.

The step of forming a first blade assembly may involve forming a first blade assembly with a third blade that is formed at least in part from the single piece that also defines at least a part of the first blade and first web. The third blade has a third substantially flat surface residing in a third plane that is substantially parallel to the first axis with the first and third surfaces at diametrically opposite first and third locations with respect to the first axis.

The method may further including the step of fastening the first blade assembly to at least one of the second blade assembly and support at a location spaced from the first axis.

BRIEF DESCRIPTION OF THE DRAWINGS

FIG. 4 is an axial view of a first blank used to form the first blade assembly on the apparatus in FIG. 2;

FIG. 5 is a view as in FIG. 4 of a flat blank used to form the second blade assembly on the apparatus in FIG. 2;

DETAILED DESCRIPTION OF THE DRAWINGS

Figure 1:
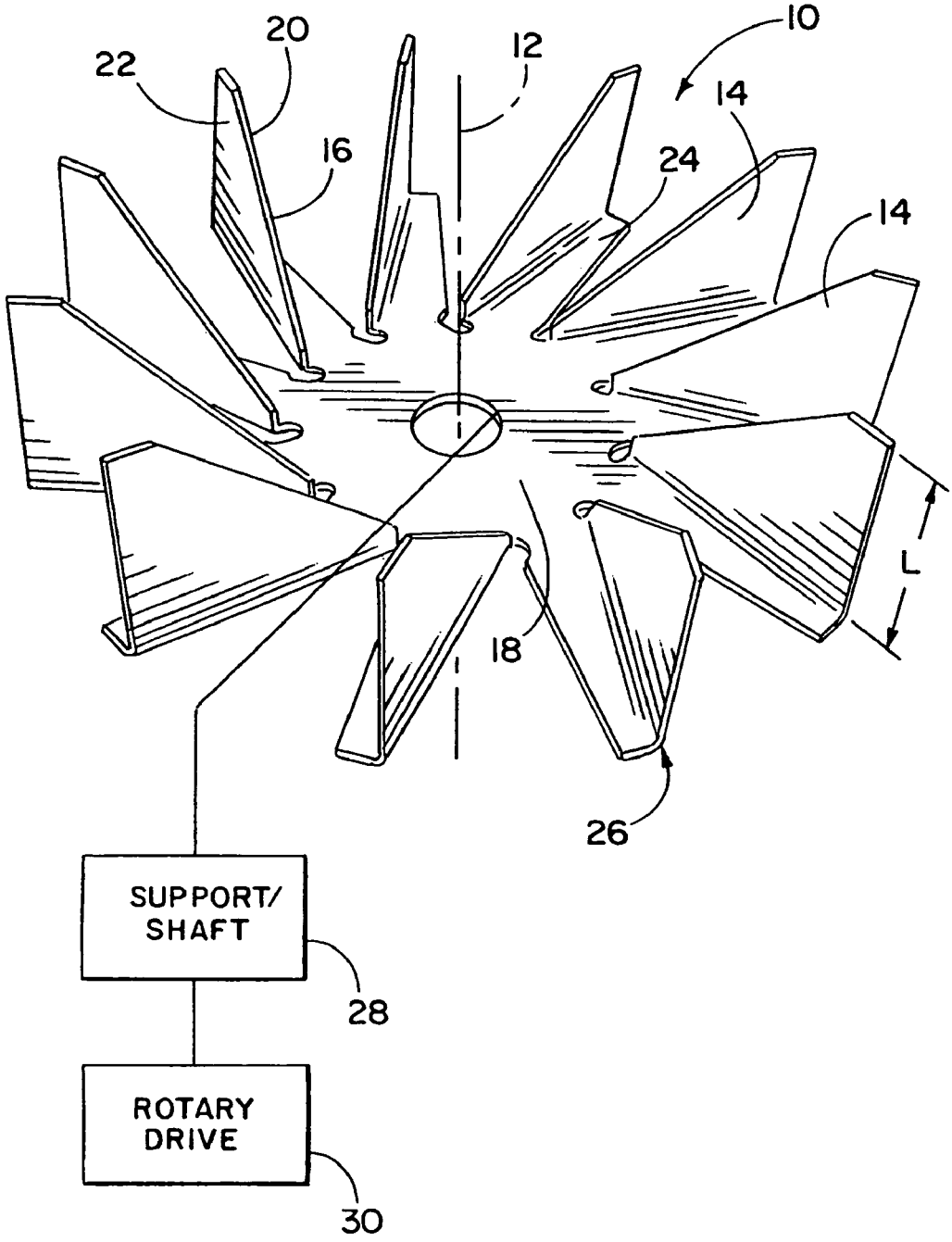
FIG. 1 (PRIOR ART)
FIG. 1 is a perspective view of a conventional, one-piece, bladed apparatus that is rotatable around an axis to propel an intercepted fluid in a radial direction.

In FIG. 1, a conventional apparatus is shown at 10 that is rotatable around an axis 12 to propel an intercepted fluid in a radial direction relative to the axis 12. The apparatus 10 is made from a single piece of metal, initially in a flattened state, that is struck at circumferentially spaced locations to define a corresponding number of blades 14, each with the same configuration. Each blade 14 has a generally triangular shape with a bounding edge 16. Each blade 14 is bent with respect to a flat web 18 so that oppositely facing flat surfaces 20,22 on each blade 14 reside in planes that are substantially parallel to the axis 12.

The triangular configuration of the blades 14 maximizes the axial length L for each blade at the outer perimeter edge 26 of the apparatus 10. The web 18 has radially projecting arms 24, each of which has an associated blade 14. The arms 24 have a sufficient circumferential dimension that the blades 14 are rigidly supported thereby in the state shown without permitting appreciable reorientation of the blades 14 under load in use.

In operation, the web 18 is mounted suitably to a support/shaft 28 that is connected to a rotary drive 30. As the drive 30 is operated, the shaft 28, fixedly connected to the web 18, drives the web 18, and thus the integrally formed blades 14, around the axis 12. Depending upon the direction of rotation around the axis 12, either the flat surfaces 20, or the flat surfaces 22, on the blades 14 are primarily responsible for propelling the intercepted fluid flow radially/centrifugally relative to the axis 12.

The length L, and thus the area of the surfaces 20,22, is inherently limited by the dimensions of the starting sheet from which the apparatus 10 is formed, and the number of blades 14. That is, starting with a circular blank of flattened metal, as the number of blades increases, the maximum area of the surfaces 20,22 decreases. If it is desired to increase the length L with a specified number of blades 14, the radial dimension of the starting sheet would have to be increased. This in turn may require a thicker gauge of material to maintain desired rigidity/integrity during operation. Thus, the cost and overall dimensions of the device may increase detrimentally. As a consequence, while it is desirable, from the standpoint of manufacturing convenience and cost, to make apparatus of this type from a single piece of formable material, the available operating space and system requirements may make this method of manufacturing the apparatus impractical for certain applications.

Figure 2:
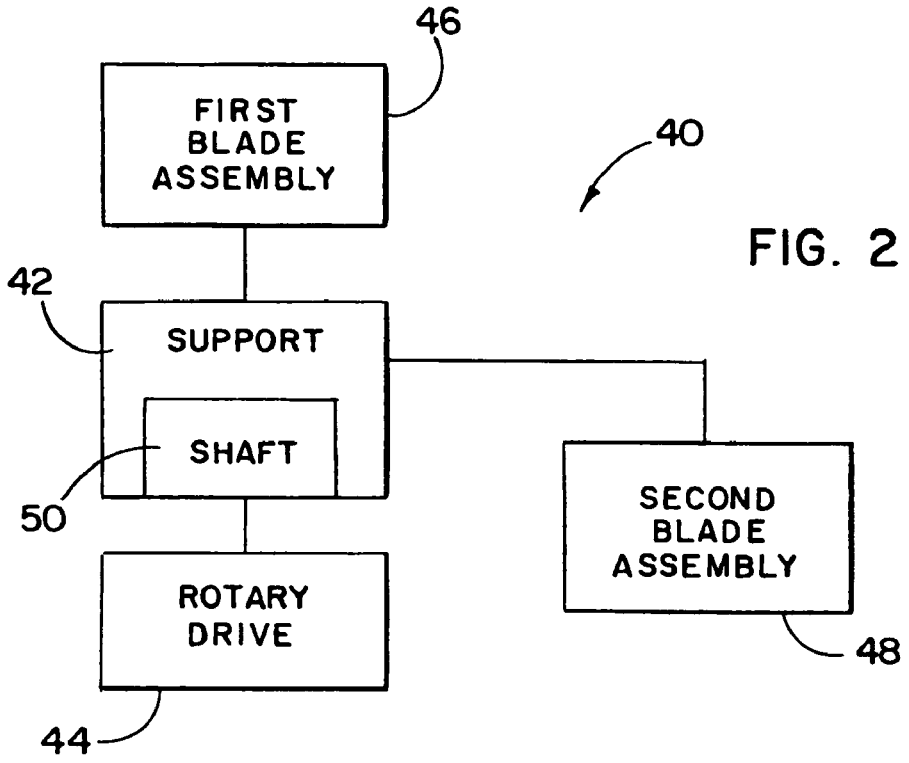
FIG. 2 is a schematic representation of one form of bladed apparatus, according to the present invention, that is rotatable around a first axis to propel an intercepted fluid in a radial direction.

The invention contemplates the ability to utilize the basic manufacturing method described with respect to FIG. 1, to produce virtually any configuration of apparatus without the constraints associated with a single piece construction. More particularly, as shown schematically in FIGS. 2 and 3, the invention contemplates two basic different arrangement of components. As shown in FIG. 2, the inventive apparatus 40 consists of a support 42 that is moved by a rotary drive 44 around a first axis. First and second blade assemblies 46,48, respectively, are mounted to the support 42 so as to follow rotary movement thereof. Each of the first and second blade assemblies 46,48 is made up of at least one, and preferably two or more, individual blades that cooperatively propel intercepted fluid in a radial direction relative to the first axis as the apparatus 40 is rotated around the first axis.

Figure 3:
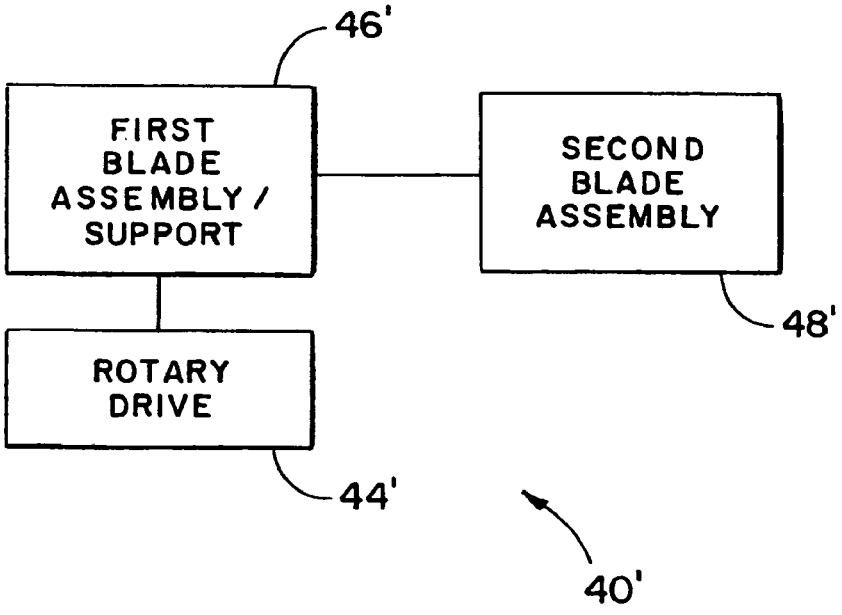
FIG. 3 is a schematic representation as in FIG. 2 of a modified form of the inventive apparatus.
Figure 6:
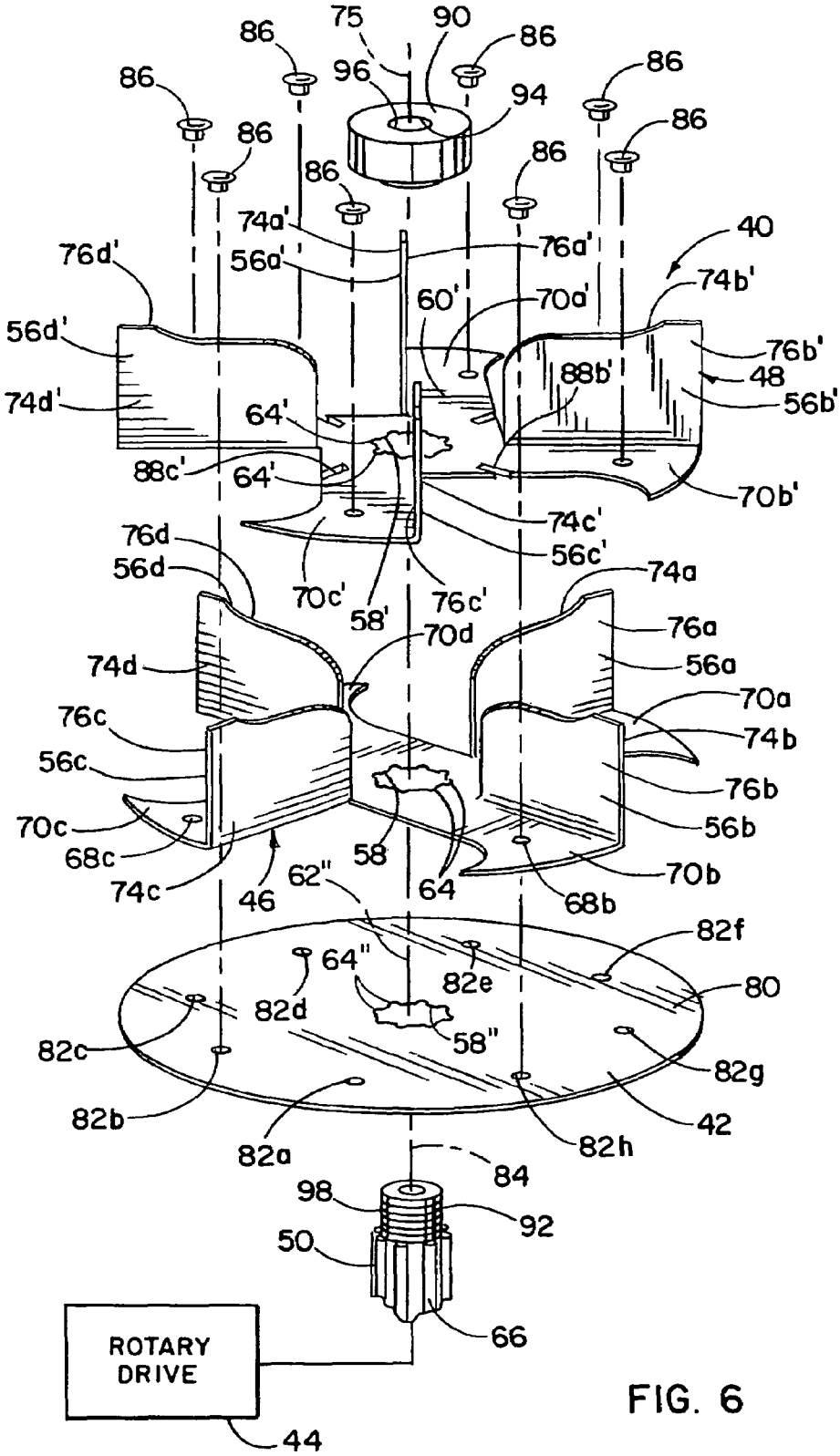
FIG. 6 is an exploded, perspective view of the first and second blade assemblies in FIGS. 4 and 5 on the support, shown schematically in FIG. 2.
Figure 7:
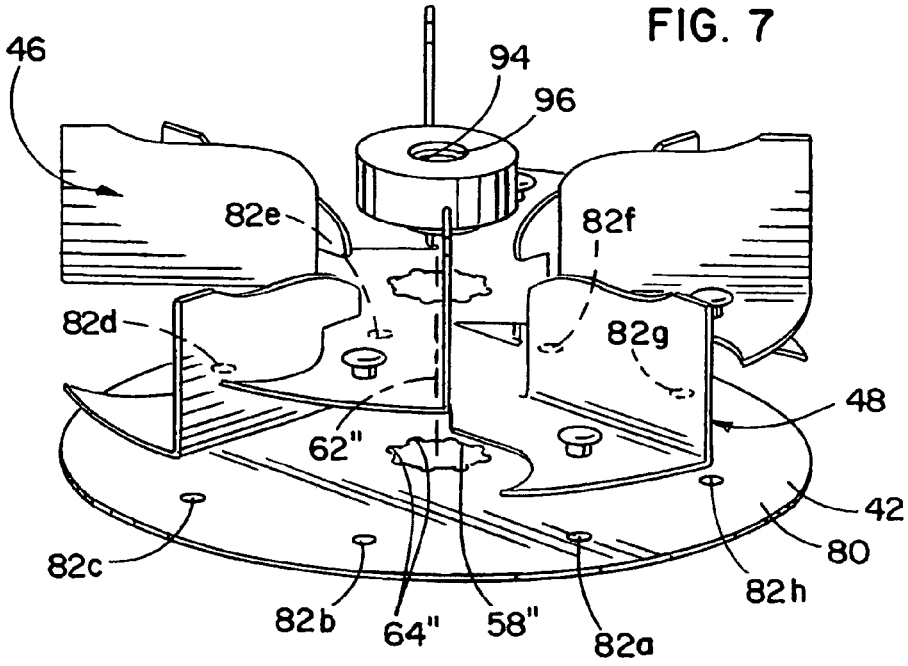
FIG. 7 is an exploded, perspective view of the first and second blade assemblies and support in FIG. 6 from a different perspective than in FIG. 6.
Figure 8:
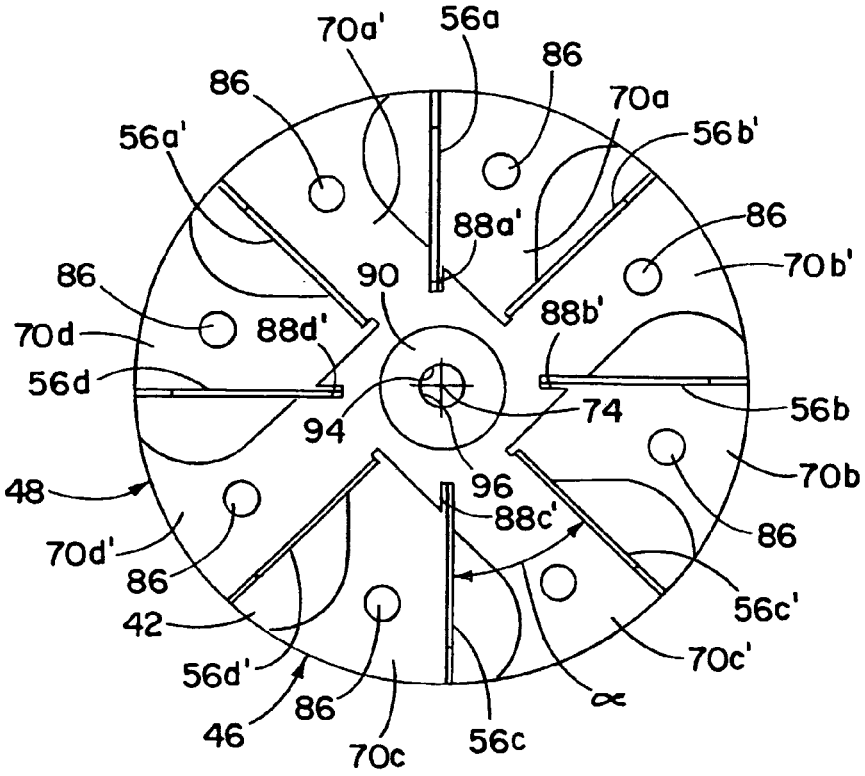
FIG. 8 is an axial view of the apparatus in an assembled state with the first and second blade assemblies in an operative position on the support.
Figure 9:
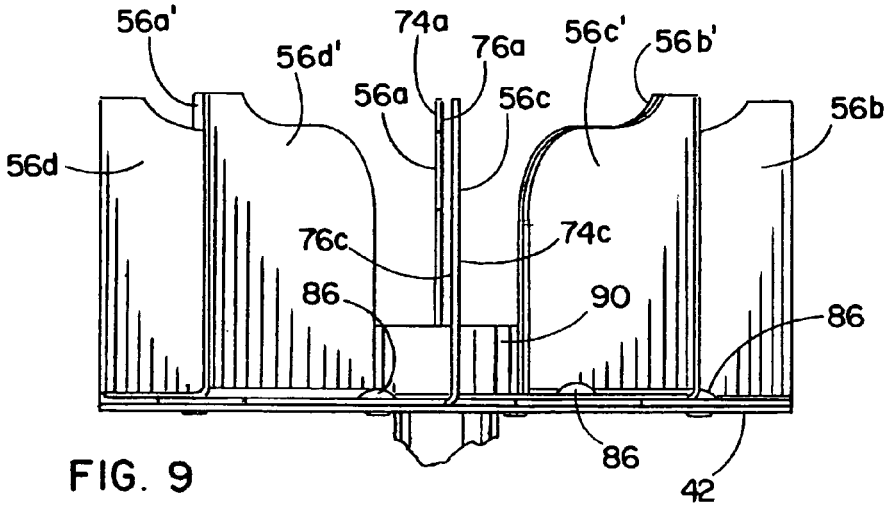
FIG. 9 is a side elevation view of the apparatus in an assembled state.
Figure 10:
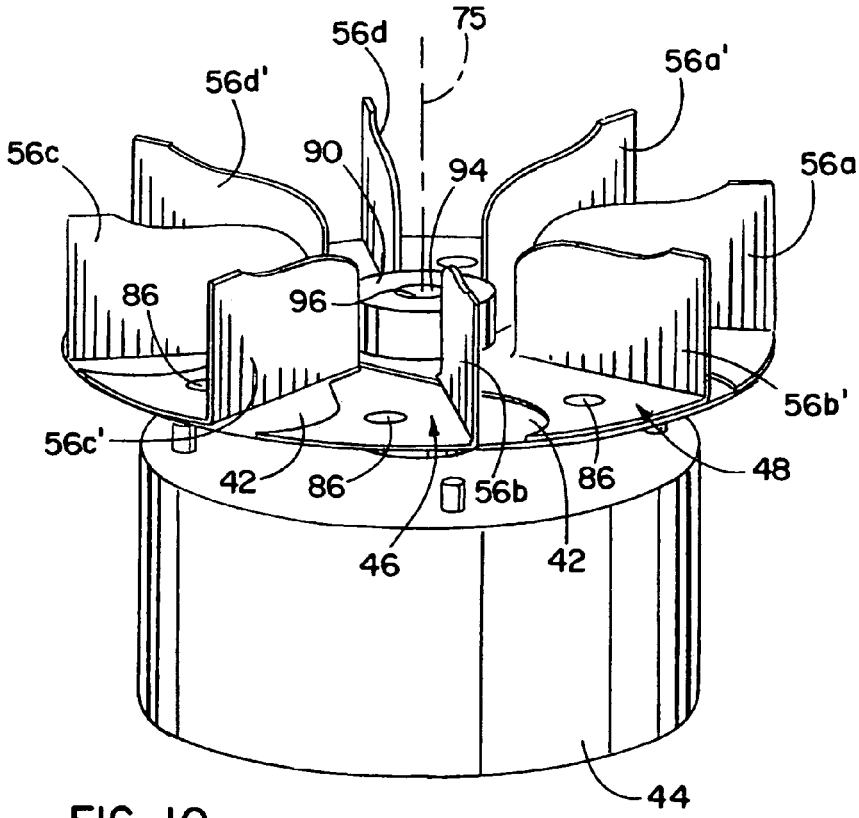
FIG. 10 is a perspective view of the apparatus mounted on a shaft on the rotary drive, shown schematically in FIG. 2.

In an alternative form, as shown in FIG. 3, the apparatus 40' has a corresponding first blade assembly 46' that defines at least a part of the support that is moved in operation by the rotary drive 44' around the first axis. A second blade assembly 48' is joined to the first blade assembly/support 46'. The first blade assembly/support 46' and second blade assembly 48' each has one, and preferably at least two, blades that are caused to rotate around the first axis to cooperatively propel intercepted fluid in a radial direction relative to the first axis as the rotary drive 44' is operated.

For purposes of simplicity, the invention will be described in detail with respect to the apparatus 40, with it being understood that the same principles apply in making the apparatus shown at 40' in FIG. 3. Details thereof are shown in FIGS. 4-10. As shown in FIG. 2, the support 42 includes a shaft 50 that is operatively associated with the rotary drive 44 to follow rotational movement thereof in operation. The shaft 50 may be integrally formed with the support 42 or separately formed therefrom and attached thereto.

A flat blank 52, from which the first blade assembly 46 is formed, is shown in FIG. 4. The blank 52 may be made from any formable material. Metal from an appropriate gauge would most commonly be utilized. The blank 52 has a circular shape that is struck by an appropriate cutter or cutters to define lines 54*a*, 54*b*, 54*c*, 54*d* corresponding to the outline of a like number of blades 56*a*, 56*b*, 56*c*, 56*d*. At the same time, or separately, a shaft receiving opening 58 is formed through the central portion of a web 60, which supports the blades 54*a*-54*d*. The opening 58 is concentric with the central axis 62 for the first blade assembly 46. In this particular configuration, the opening 58 has a plurality of lobes 64 to accommodate axial splines 66 on the shaft 50 of the rotary drive 44 that is directed therethrough, as hereinafter described.

Openings 68*a*,68*b*,68*c*,68*d* may be provided, one each, on radially projecting web arms 70*a*,70*b*,70*c*,70*d*, consecutively. These openings 68*a*-68*d* may be formed simultaneously with the formation of the lines 54*a*-54*d* and/or opening 58, or in a separate operation, before or after the first blade assembly 46 is joined to the second blade assembly 48 and support 42.

The blades 56*a*, 56*b*, 56*c*, 56*d* are bent about fold lines 72*a*, 72*b*, 72*c*, 72*d* so that oppositely facing, and parallel, flat surfaces: 74*a*, 76*a* on the blade 56*a*; 74*b*, 76*b* on the blade 56*b*; 74*c*, 76*c* on the blade 56*c*; and 74*d*, 76*d* on the blade 56*d*, reside in planes that are substantially parallel to a first axis 75 about which the apparatus 40 is moved by the drive 44 in use, with the first blade assembly 46 in an operative position on the support 42, as described hereinbelow.

The second blade assembly 48 is constructed from a flat blank 52', as shown in FIG. 5, that may correspond in shape and material to the blank 52. However, it is not a requirement that the material, its gauge, or shape be the same as that for the flat blank 52. Lines 54*a*', 54*b*', 54*c*', 54*d* are stuck in the blank 52' with a cutter or cutters in one or more steps to define blades 56*a*',56*b*',56*c*',56*d*', corresponding potentially in shape and size to the blades 56*a*, 56*b*, 56*c*, 56*d*, consecutively. Thereafter, the blades 56*a*', 56*b*', 56*c*', 56*d*' are bent around fold lines 72*a*', 72*b*', 72*c*', 72*d*' so that oppositely facing and substantially parallel flat surfaces: 74*a*',76*a*' on the blade 56*a*'; 74*b*',76*b*' on the blade 56*b*'; 74*c*',76' on the blade 56*c*'; and 74*d*',76*d*' on the blade 56*d*', are oriented so that the planes thereof extend generally parallel to the first axis 75, with the second blade assembly 48 in an operative position on the support 42.

The flat blank 52' has a web 60' with radially projecting arms 70*a*', 70*b*', 70*c*', 70*d*' to which the blades 56*a*', 56*b*', 56*c*', 56*d*' are connected. Web arms 70*a*', 70*b*', 70*c*', 70*d*' have opening 68*a*', 68*b*', 68*c*', 68*d*', consecutively therethrough, each at locations spaced from the central axis 62' for the flat blank 52'. At the center of the web 60', an opening 58', having a shape substantially the same as the opening 58, is provided. The opening 58' has lobes 64' therearound.

The support 42 is in the form of a flat, circular plate 80 with a diameter generally corresponding to that for the flat blanks 52, 52'. The flat plate 80 has an opening 58" at the central axis 62" for the flat plate 80. The opening 58" has the same shape as the openings 58, 58', including circumferentially spaced lobes 64" therearound. The flat plate 80 has a series of openings 82*a*, 82*b*, 82*c*, 82*d*, 82*e*, 82*f*, 82*g*, 82*h* spaced equidistantly circumferentially around, and in spaced relationship to, the central axis 62".

To assemble the apparatus 40, the flat plate 80, defining the support 42, is attached to the shaft 50 by directing the shaft 50 through the opening 58" at the center thereof. The splines 66 and lobes 64" make a keyed connection to prevent relative rotational movement between the shaft 50 and plate 80 around the shaft axis 84, that is coincident with the first axis 75. The first blade assembly 46 is then stacked axially upon the support plate 80, such that the shaft 50 projects through the opening 58 and makes a corresponding keyed connection therewithin. The splines 66 and lobes 64", 64 are angularly oriented so that with the shaft 50 directed through the openings 58", 58 and keyed therewithin, the openings 68*a*, 68*b*, 68*c*, 68*d* on the web arms 70*a*, 70*b*, 70*c*, 70*d* align, one each with one of the opening 82*a*-82*h* through the support plate 80, to allow a fastener 86 to be directed therethrough at locations spaced equidistantly circumferentially from each other and the first axis 75 about which the apparatus 40 rotates in operation. With this arrangement, the first blade assembly 46 is fixed with respect to the support plate 80 with the blades 56*a* ,56*b*, 56*c*, 56*d* projecting parallel to the axis 75 and offset from each other by approximately 90°.

The second blade assembly 48 is thereafter axially stacked upon the first blade assembly 46 by again directing the shaft 50 through the opening 58' formed through the web 60' thereon. The lobes 64' in the opening 58' are situated so that with keyed connection between the shaft 50 and opening 58' established, the blades 56*a*', 56*b*', 56*c*', 56*d*' each reside centered between a pair of the blades 56*a*, 56*b*, 56*c*, 56*d* on the first blade assembly 46. Accordingly, the blades 56*a*, 56*b*, 56*c*, 56*d*, 56*a*', 56*b*', 56*c*', 56*d*' are spaced, each from the blades thereadjacent, through an angle a equal to approximately 45°.

To permit this staggered angular relationship between the first and second blade assemblies 46,48, the web arms 70*a*',

70*b*', 70*c*', 70*d*' on the second blade assembly 48 have blade receiving cutouts 88*a*', 88*b*', 88*c*', 88*d*', to respectively receive a portion of the blades 56*a*, 56*b*, 56*c*, 56*d* on the first blade assembly 46.

With the second blade assembly 48 in its operative position, the openings 68*a*', 68*b*', 68*c*', 68*d*' align, one each, with one of the openings 82*a*-82*h* in the support 42 so that the fasteners 86 can be directed therethrough.

The fasteners 86 may be threaded fasteners, rivets, or the like, to securely maintain the first and second blade assemblies 46,48 in their operative positions upon the support 42, whereupon the first and second blade assemblies 46,48 and support 42 define a unitary structure. This unitary structure can be fixed upon the shaft 50 by a securing element 90. In this embodiment, the shaft 50 has a threaded free end 92. The securing element has a bore 94 with internal threads 96 that are complementary to threads 98 at the free end 92 of the shaft 50.

The securing element 90 could be fixed alternatively as by a set screw, pin, or by any other means known to those skilled in the art.

As seen in FIG. 4, the first blade assembly 46 may be constructed with optional blade receiving cutouts 88*a*,88*b*, 88*c*,88*d* which do not significantly weaken the web 60. This permits the first and second blade assemblies 46,48 to made with an identical configuration. Each blade 56*a*, 56*b*, 56*c*, 56*d*, 56*a*', 56*b*', 56*c*', 56*d*' on each of the blade assemblies 46,48 has a balancing blade at a diametrically opposite location with respect to the first axis 75. Exemplary diametrically opposite blades 56*a*, 56*c* have oppositely facing blade surfaces 74*a*, 76*a*; 74*c*, 76*c*, respectively, that all reside in substantially parallel planes.

Figure 11:
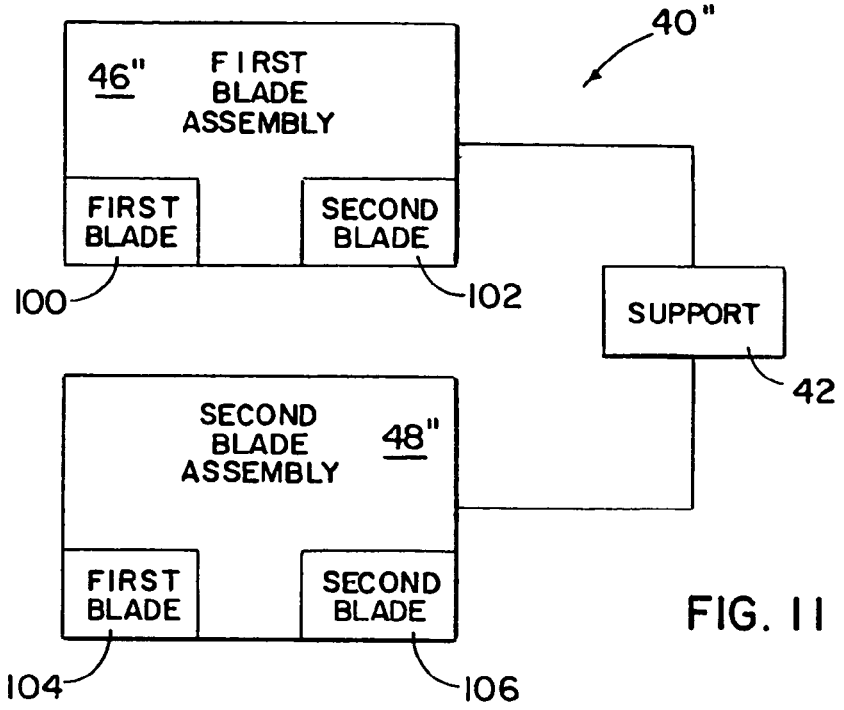
FIG. 11 is a schematic representation of a further modified form of apparatus, according to the present invention.

As shown in FIG. 11, a modified form of the apparatus of the type shown in FIG. 2 is shown at 40", with a first blade assembly 46" and a second blade assembly 48". Rather than having four blades, the first blade assembly 46" has diametrically opposite first and second blades 100,102, with the second blade assembly 48" having diametrically opposite first and second blades 104,106.

Figure 12:
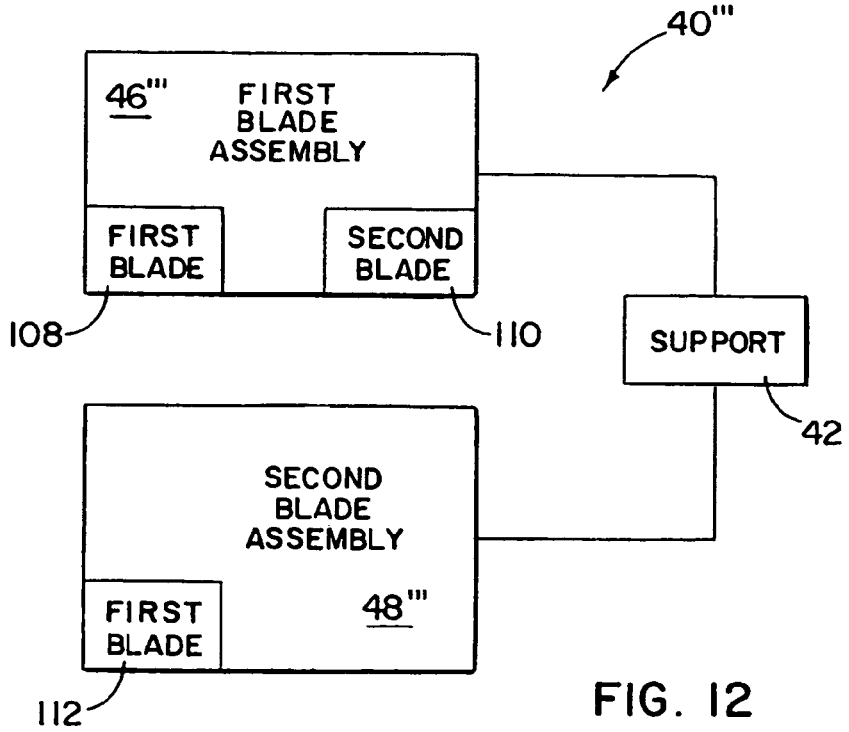
FIG. 12 is a schematic representation of another form of apparatus, according to the present invention.
Figure 13:
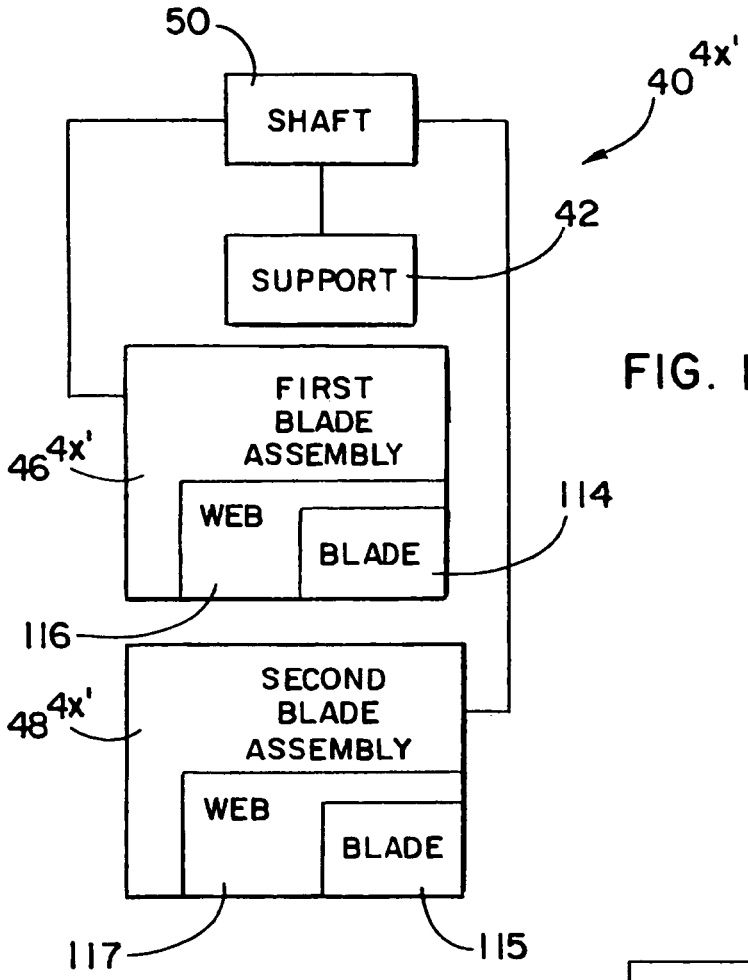
FIG. 13 is a schematic representation of a still further form of apparatus, according to the present invention.

As a further alternative form of the apparatus, shown at 40"' in FIG. 12, the first blade assembly 46"' has first and second blades 108,110 that may or may not be at diametrically opposite locations. The second blade assembly 48"' has at least a first blade 112 that resides at one radial location. The first and second blade assemblies 46"',48"' are attached to the support 42 in axially stacked relationship. The blades on the first and second blade assemblies 46"', 48"' may be diametrically opposite or otherwise.

In a still further modified form of the apparatus, as shown at $\mathbf{40}^{4x'}$ in FIG. 12, first and second blade assemblies $\mathbf{46}^{4x'}$ and $\mathbf{48}^{4x'}$ are provided, each having a single blade 114,115 on a web 116,117. The shaft 50 on the support 42 is directed through the webs 116, 117 of the axially stacked blade assemblies $\mathbf{46}^{4x'}$, $\mathbf{48}^{4x'}$. Additional blade assemblies can be mounted in similar fashion to produce the total number of blades desired.

It can be seen that potentially all of the first and second blade assemblies can be made from a single piece of flat, formable stock that can be struck and bent to produce the desired blade configurations. While the blade assemblies may be formed from sheet metal stock, the invention contemplates formation by using other materials and construction techniques. The configuration for each blade assembly is limited only by the diameter of the particular blank from which it is formed. As one example, circular blades may be struck to produce only two (2) blades from a circular blank, to thereby maximize the axial extent thereof. The number of blade assemblies is likewise not limited. It is not a requirement that the blanks be circular.

Figure 14:
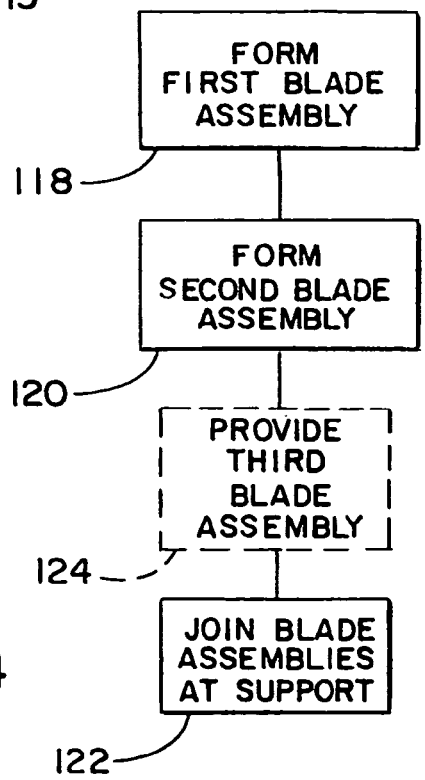
FIG. 14 is a flow diagram representation of a method for forming an apparatus, according to the present invention.

As one example, the inventive apparatus can be formed by practicing the steps as shown in FIG. 14. As shown at block 118, a first blade assembly is formed, as described above with one or more blades, and in the latter case with blades that are at diametrically opposite locations or at another angular relationship. A second blade assembly is formed in like fashion, as shown at block 120.

As shown at block 122, the blade assemblies are joined at a support to produce a unitary assembly that is rotatable around an axis so that the blades on the first and second blade assemblies cooperatively propel intercepted fluid in a radial direction. Optionally, as shown in FIG. 14 in dotted lines, a third blade assembly may be provided and joined with the other blades assemblies at the support 122, as shown at block 124.

While the invention has been described with particular reference to the drawings, it should be understood that various modifications could be made without departing from the spirit and scope of the present invention.

The invention claimed is:

1. An apparatus that is rotatable around a first axis to propel an intercepted fluid in a radial direction, the apparatus comprising:

a support capable of being rotated around the first axis;

a first blade assembly on the support and comprising a first blade having a first substantially flat surface residing in a first plane that is substantially parallel to the first axis; and a second blade assembly comprising second and third blades respectively having second and third substantially flat surfaces residing respectively in second and third planes each extending substantially parallel to the first axis with the second blade assembly in an operative position on the support, there being a single piece that defines at least a part of the second and third substantially flat surfaces, the second blade assembly separate from the first blade assembly and joined to the support in the operative position so that the first, second and third blades cooperatively propel intercepted fluid in a radial direction relative to the first axis as the apparatus is rotated around the first axis.

2. The apparatus according to claim 1 wherein the single piece comprises a formable material that is bent to define the first and second blades.

3. The apparatus according to claim 2 wherein with the second blade assembly in the operative position, the second and third blades are at diametrically opposite second and third locations relative to the first axis.

4. The apparatus according to claim 3 wherein there is a first web that connects between the second and third blades and through which the second blade assembly is joined to the support.

5. The apparatus according to claim 2 wherein the first blade assembly comprises a fourth blade with a fourth substantially flat surface that is in a fourth plane that is substantially parallel to the first axis.

6. The apparatus according to claim 5 wherein there is a single piece that defines at least a part of the first and fourth substantially flat surfaces.

7. The apparatus according to claim 6 wherein the first blade assembly comprises a second web that connects between the first and fourth blades and through which the first blade assembly is joined to the support in an operative position.

8. The apparatus according to claim 1 wherein at least one of the first and second blade assemblies defines at least a part of the support.

9. The apparatus according to claim 5 wherein the first and fourth blades are at diametrically opposite first and fourth locations relative to the first axis.

10. The apparatus according to claim 1 wherein the first and second blade assemblies are stacked axially with respect to the first axis, one upon the other.

11. The apparatus according to claim 7 wherein there is a first web that connects between the second and third blades and the support comprises a shaft that extends through the first and second webs.

12. The apparatus according to claim 11 wherein the shaft has a free end and the apparatus further comprises a securing element that is attached to the free end of the shaft.

13. The apparatus according to claim 1 wherein the second and third planes are substantially parallel to each other.

14. The apparatus according to claim 13 wherein the first blade assembly comprises a fourth blade with a fourth substantially flat surface that is in a fourth plane that is substantially parallel to the first axis and the first and fourth planes are substantially parallel to each other.

15. The apparatus according to claim 4 wherein the first web and second and third blades are made from a single piece of formable material that is bent from an initially flattened state to define the first web and second and third blades.

16. The apparatus according to claim 4 wherein the first blade assembly comprises a second web that connects between the first and fourth blades and through which the first blade assembly is joined to the support in an operative position and the first web is connected by a fastener to at least one of the second web and support at a location spaced from the first axis.

17. The apparatus according to claim 11 wherein there is a third blade assembly comprising at least one blade and a third web and the shaft extends through the third web to maintain the third blade assembly in an operative position on the support.

18. The apparatus according to claim 15 wherein the formable material comprises metal.

19. An apparatus that is rotatable around a first axis to propel an intercepted fluid in a radial direction, the apparatus comprising:

a support capable of being rotated around the first axis and comprising a shaft;

a first blade assembly comprising a first blade having a first flat surface residing in a first plane and a first web; and a second blade assembly separate from the first blade assembly and comprising a second blade having a second flat surface residing in a second plane and a second web, the shaft extending through the first and second webs to maintain the first and second blade assemblies each in an operative position wherein the first and second planes are substantially parallel to the first axis and the first and second blades cooperatively propel intercepted fluid in a radial direction relative to the first axis as the apparatus is rotated around the first axis.

20. The apparatus according to claim 19 wherein the first blade assembly is formed from a single piece of formable material that is bent to define the first web and first blade.

21. The apparatus according to claim 20 wherein the first blade assembly comprises a third blade formed at least in part from the single piece that also defines at least a part of the first blade and first web, the third blade having a third substantially flat surface that resides in a third plane that is substantially parallel to the first axis with the first blade assembly in its operative position.

22. The apparatus according to claim 19 wherein the first web is connected by a fastener to at least one of the support and the second web at a location spaced from the first axis.

23. The apparatus according to claim 21 wherein the first and third substantially flat surfaces are substantially parallel to each other.

24. The apparatus according to claim 21 wherein the single piece of formable material comprises a flattened piece of metal that is bent to define the first web and first and third blades.

25. A method of forming an apparatus that is rotatable around a first axis to propel an intercepted fluid in a radial direction, the method comprising the steps of:

forming a first blade assembly comprising at least a first blade having a first substantially flat surface residing in a first plane and a first web;

forming a second blade assembly comprising at least a second blade having a second substantially flat surface residing in a second plane and a second web; and joining the first and second webs together at a support that is rotatable around the first axis so that the first and second planes align to be substantially parallel to the first axis and the first and second blades cooperatively propel intercepted fluid in a radial direction as the apparatus is rotated around the first axis.

26. The method of forming an apparatus according to claim 25 wherein the step of forming the first blade assembly comprises forming the first blade assembly from a single piece of formable material that is bent to define the first web and first blade.

27. The method of forming an apparatus according to claim 26 wherein the support comprises a shaft and the step of joining the first and second webs together comprises directing the shaft axially relative to the first axis through the first and second webs and attaching a securing element to the shaft.

28. The method of forming an apparatus according to claim 26 wherein the step of forming a first blade assembly comprises forming a first blade assembly comprising a third blade that is formed at least in part from the single piece that also defines at least a part of the first blade and first web, the third blade having a third substantially flat surface residing in a third plane that is substantially parallel to the first axis with the first and third surfaces at diametrically opposite first and third locations with respect to the first axis.

29. The method of forming an apparatus according to claim 27 further comprising the step of fastening the first blade assembly to at least one of the second blade assembly and support at a location spaced from the first axis.

* * * * *